US010274292B1

(12) United States Patent
Lillo et al.

(10) Patent No.: US 10,274,292 B1
(45) Date of Patent: Apr. 30, 2019

(54) ALLOYS FOR SHAPED CHARGE LINERS METHOD FOR MAKING ALLOYS FOR SHAPED CHARGE LINERS

(71) Applicants: Thomas Martin Lillo, Idaho Falls, ID (US); Henry S. Chu, Idaho Falls, ID (US)

(72) Inventors: Thomas Martin Lillo, Idaho Falls, ID (US); Henry S. Chu, Idaho Falls, ID (US)

(73) Assignee: U.S. Department of Energy, Washington, DC (US)

( * ) Notice: Subject to any disclaimer, the term of this patent is extended or adjusted under 35 U.S.C. 154(b) by 239 days.

(21) Appl. No.: 14/623,987

(22) Filed: Feb. 17, 2015

(51) Int. Cl.

| | |
|---|---|
| ***F42B 1/032*** | (2006.01) |
| ***C22F 1/10*** | (2006.01) |
| ***C22C 19/03*** | (2006.01) |
| ***C22C 1/02*** | (2006.01) |
| ***F42B 1/028*** | (2006.01) |

(52) U.S. Cl.
CPC ..... *F42B 1/032* (2013.01); *C22C 1/023* (2013.01); *C22C 19/03* (2013.01); *C22F 1/10* (2013.01); *F42B 1/028* (2013.01)

(58) Field of Classification Search
CPC ..... F42B 1/32
See application file for complete search history.

(56) References Cited

U.S. PATENT DOCUMENTS 5,331,895 A * 7/1994 Bourne ..... F42B 1/032 102/307
5,936,184 A * 8/1999 Majerus ..... F42B 3/08 102/306
6,270,549 B1 * 8/2001 Amick ..... C22C 1/0433 102/517

(Continued)

OTHER PUBLICATIONS

Michael T. Stawovy, et al., "High Density Nickel Based Alloy for Warhead Liner Applications," 2008 NDIA Warheads & Ballistics Classified Symposium, Feb. 11-14, 2008, Monterey CA, pp. 1-12.

(Continued)

*Primary Examiner* — Aileen B Felton
(74) *Attorney, Agent, or Firm* — Felisa L. Leisinger; Michael J. Dobbs; Brian J. Lally

(57) ABSTRACT

One embodiment of the invention provides an alloy with a density greater than 10 g/cm$^3$, the alloy comprising a single phase solution of tungsten, nickel, and iron. Also provided is a cone liner for use in shaped charges, the liner comprised of a tungsten, nickel, iron alloy having a single phase microstructure. Substantially no precipitates or second phases exist in the alloy. One embodiment of the invention further provides a method for producing a single phase alloy, the method comprising establishing a melt of iron and nickel; dissolving tungsten in the melt to form a solution; wherein the atomic percents of the nickel, tungsten and iron range from between approximately Ni-7%W-0%Fe, Ni-18%W-0%Fe, and Ni-8%W-24%Fe, wherein Ni is the remainder, maintaining the solution at a first temperature sufficient to create a homogeneous mixture; allowing the (Continued)

homogeneous mixture to solidify; and thermochemically treating the solidified mixture for a time to dissolve any second phases or microstructure within the mixture.

7 Claims, 4 Drawing Sheets

(56) References Cited

U.S. PATENT DOCUMENTS

| | | | | |
|---|---|---|---|---|
| 6,354,219 | B1 * | 3/2002 | Pratt | F42B 1/032 102/306 |
| 6,378,438 | B1 * | 4/2002 | Lussier | F42B 1/032 102/306 |
| 2005/0241522 | A1 * | 11/2005 | Stawovy | F42B 1/032 102/476 |
| 2010/0275800 | A1 * | 11/2010 | Stawovy | F42B 1/032 102/306 |

OTHER PUBLICATIONS

Y. Liu, et al. "Design of powder metallurgy titanium alloys and composites," Materials Science and Engineering:A, vol. 418, Issue 1-2, Feb. 2006, pp. 25-35.

* cited by examiner

ALLOYS FOR SHAPED CHARGE LINERS METHOD FOR MAKING ALLOYS FOR SHAPED CHARGE LINERS

GOVERNMENT INTERESTS

The United States Government has rights in this invention pursuant to Contract No. DE-AC07-05ID14517, between the U.S. Department of Energy (DOE) and the Battelle Energy Alliance LLC.

BACKGROUND OF THE INVENTION

1. Field of the Invention

The embodiments described herein relate to shaped charge liners, and more specifically, this invention relates to shaped charge liners and a method for producing shaped charge liners with exceptional densities.

2. Background of the Invention

Shaped charges are explosive charges configured to focus the effect of the explosive's energy. Various types are used to cut and form metal, initiate nuclear weapons, penetrate armor, and complete or "pelf" wells in the oil and gas industry.

Typical modern shaped charges, with a metal liner encapsulating the charge cavity, can penetrate armor steel to a depth of seven (7) or more times the diameter of the charge (charge diameters, CD). Depths of more than 10 CD have been achieved. Contrary to a widespread misconception, most likely caused by the acronym HEAT, the shaped charge does not depend in any way on heating or melting for its effectiveness; that is, the jet from a shaped charge does not melt its way through armor; rather its effect is purely kinetic in nature. Rather, a high-explosive anti-tank warhead (HEAT) is a munition made of an explosive shaped charge that uses the Munroe effect to create a very high-velocity partial stream of metal in a state of superplasticity, which is used to penetrate solid vehicle armor. (The Munroe or Neumann effect is the focusing of blast energy by a hollow or void cut on a surface of explosive.)

A typical shaped charge device consists of a solid cylinder of explosive with a metal-lined conical hollow in one end and a central detonator, array of detonators, or detonation wave guide at the other end. Explosive energy is released directly away from (e.g. normal to) the surface of an explosive, so shaping the explosive will concentrate the explosive energy in the void. If the hollow is properly shaped (usually conically), the enormous pressure generated by the detonation of the explosive drives the liner in the hollow cavity inward to collapse upon its central axis. The resulting collision forms and projects a high-velocity jet of metal particles forward along the axis. Most of the jet material originates from the innermost part of the liner, a layer of about 10 percent to 20 percent of the thickness. The rest of the liner forms a slower-moving slug of material, which, because of its appearance, is sometimes called a "carrot" or a "slug."

Axial length, density and velocity of the jet are the three fundamental parameters governing the penetration performance of a shaped-charge. The engineering design (cone angle, liner wall thickness and geometry) and explosive formulation etc are subset parameters to give the highest length and velocity.

FIG. 1 depicts a prior art shaped charge, designated therein as numeral 10. The shaped construct 10 comprises an aerodynamic cover 12, an air- or fluid-filled cavity 14, a conical liner 16 disposed between the cover and the cavity, a detonator 18 disposed at the proximal end of the construct, and an explosive 20 in close spatial relation to the detonator. The distal end of the construct 10 terminates in a piezoelectric trigger 22.

The most common shape of the liner is conical, with an internal apex angle of 40 to 90 degrees. Different apex angles yield different distributions of jet mass and velocity. Small apex angles can result in jet bifurcation, or even in the failure of the jet to form at all; this is attributed to the collapse velocity being above a certain threshold, normally slightly higher than the liner material's bulk sound speed. Other widely used shapes include hemispheres, tulips, trumpets, ellipses, and bi-conics; the various shapes yield jets with different velocity and mass distributions.

Prior Material

Types Detail

Liner material is chosen for specific ranges of applications. For example, if the shaped-charge is intended to fracture geological structures such as oil contained rock strata, glass would be preferred liner material. As another example, light weight material such as aluminum or Teflon is selected as the liner material if the objective of the shaped-charge is to pre-initiate reactive armor. Steel liner is used mainly to cut massive support columns or as a demolition device.

Liners have been made from many materials, including various metals and glass. Several metallic elements have been tried, including aluminum, tungsten, tantalum, depleted uranium, lead, tin, cadmium, cobalt, magnesium, titanium, zinc, zirconium, molybdenum, beryllium, nickel, silver, and even gold and platinum. The selection of the material depends on the target to be penetrated; for example, aluminum has been found advantageous for concrete targets. The use of cobalt in some alloys (for example Ni—W—Co) results in expensive liners.

The deepest penetrations are achieved with a dense, ductile metal, with copper a common choice as discussed infra. For some modern anti-armor weapons, molybdenum and pseudo-alloys of tungsten filler and copper binder (9:1, thus density is about 18 $Mg/m^3$) have been adopted. These pseudo alloys are two phase composite materials. Two phase material often result in non-uniform deformation which will limit ductility and may result in a non-uniform carrot. Also, these prior art alloys rely on powder metallurgy for their formation, and that technology results in more brittle materials. Brittle materials hinder the proper formation of long cohesive shaped charge jets.

In charges for oil well completion, it is preferred that a solid slug or "carrot" not occur since it would plug the hole the liner jet just formed through the well casing and interfere with the influx of oil. Therefore, liners are often fabricated by powder metallurgy, which produce "pseudo-alloys" (e.g., sintered agglomerations of the metals). Often, partially or incompletely sintered pseudo-alloys yield jets that are composed mainly of dispersed fine metal particles. For example, the jets may be comprised partly of a solution and partly as sintered phases.

Unsintered cold pressed liner "alloys", however, are not waterproof and tend to be brittle, which makes them easy to damage during handling. Bimetallic liners, usually zinc-lined copper, can be used. During jet formation the zinc layer vaporizes and a slug is not formed; the disadvantage is an increased cost and dependency of jet formation on the quality of bonding the two layers. Low-melting-point (below 500° C.) solder/braze-like alloys (e.g., $Sn_{50}Pb_{50}$, $Zn_{97.6}Pb_{1.6}$, or pure metals like lead, zinc or cadmium) can be used; these melt before reaching petroleum well casings during perfing operations, and the molten metal does not obstruct the hole. Other alloys, binary eutectics (e.g. $Pb_{88.8}Sb_{11.1}$, $Sn_{61.9}Pd_{38.1}$, or $Ag_{71.9}Cu_{28.1}$), form a metal-matrix composite material with ductile matrix with brittle dendrites; such materials reduce slug formation but are difficult to shape.

A metal-matrix composite with discrete inclusions of low-melting material is another option; the inclusions either melt before the jet reaches the well casing, weakening the material, or serve as crack nucleation sites, and the slug breaks up on impact. The dispersion of the second phase can be achieved also with castable alloys (e.g., copper) with a low-melting-point metal insoluble in copper, such as bismuth, 1-5 percent lithium, or up to 50 percent (usually 15-30 percent) lead; the size of inclusions can be adjusted by thermal treatment. Non-homogeneous distribution of the inclusions can also be achieved. Other additives can modify the alloy properties; tin (4-8%), nickel (up to 30% and often together with tin), up to 8% aluminum, phosphorus (forming brittle phosphides) or 1-5% silicon form brittle inclusions serving as crack initiation sites. Up to 30% zinc can be added to lower the material cost and to form additional brittle phases.

The penetration depth is proportional to the maximum length of the jet, which is a product of the jet tip velocity and time to particulation. The jet tip velocity depends on bulk sound velocity in the liner material, the time to particulation is dependent on the ductility and high-temperature strength of the material. The maximum achievable jet velocity is roughly 2-2.5 times the sound velocity in the material. The speed can reach 10 km/s, peaking some 40 microseconds after detonation; the cone tip is subjected to acceleration of about 25 million g. The jet tail reaches about 2-5 km/s. The pressure between the jet tip and the target can reach one terapascal. The immense pressure makes the metal flow like a liquid, though x-ray diffraction has shown the metal stays solid; one of the theories explaining this behavior proposes a molten core and a solid sheath of the jet.

Some high-end liners can be constructed from very expensive and exotic materials such as tantalum that can only be fabricated via powder metallurgical-sintering methods. Also tantalum is more expensive than gold.

In early antitank weapons, copper was used as a liner material. Later, in the 1970s tantalum proved superior to copper, due to its much higher density and very high ductility at high strain rates. Other high-density metals and alloys tend to have drawbacks in terms of price, toxicity, radioactivity, or lack of ductility.

As noted supra, the deepest penetrations have been achieved when pure metals, such as oxygen-free high thermal conductivity (OFHC) copper are used. This is probably because they displayed the greatest ductility. High ductility delays the breakup of the jet into particles as it stretches. For typical military applications, high-purity copper is the preferred material because when processed correctly, copper has high bulk density and high bulk sound speed. Shaped-charges with liner material that possess these two main material characteristics or properties usually have very good penetration power or lethality, as noted in Walters et al, Fundamentals in Shaped-Charges (Wiley Pub. New York, 1989).

Oxygen-free high-conductivity (OFHC) high-purity copper is also very ductile, malleable and formable and therefore can be easily machined or pressure-formed into high-precision liner cone shapes—another prerequisite for high penetration.

However, in the high temperatures environs created during the shaped-charge jet formation stage, copper tends to lose a majority of its strength. When initiated from a long stand-off (i.e., the normal distance between the initiation point of the shaped charge and the front face of the target), the long continuous copper jet would eventually particulate into multiple small segments of copper metals, thus losing its penetrating power.

Economically, high-purity copper has a disadvantage of being a high-demand commodity because of competition for it in the electrical power generation and transmission, computer and semiconductors sectors. Also, in order to attain high purity with very low interstitial oxygen, repeated expensive purification processes are required. Lastly, copper has reached a plateau in penetration depth and therefore in lethality.

A need exists in the art for improved (in terms of performance and cost) alloys suitable as shaped charge liners and other explosively formed penetrator (EFP) applications. The alloys should have low ductile-to-brittle transition temperatures for maximize penetration depth of metal jets formed upon detonation of the charges. The alloy should be comprised of comparatively priced metals to those used in state of the art alloys.

SUMMARY OF INVENTION

An object of one embodiment of the invention is to provide alloys as constituents of shaped charge liners that overcomes many of the drawbacks of the prior art.

Another object of one embodiment of the invention is to provide single phase alloys and a discrete method for producing single phase alloys with optimized characteristics for shaped charge liners. Features of one embodiment of the invention include the production of alloys with high (e.g. $\geq 10$ g/cm$^3$) densities, ductilities$\geq 60$ percent, and sound speeds$\geq 5$ km/sec. An advantage of one embodiment of the invention is that it provides a unique combination of favorable charged liner alloy characteristics heretofore not attainable with a single state of the art process.

Yet another object of one embodiment of the invention is to provide alloys and a method for providing alloys for use as shaped charge liners. A feature of one embodiment of the invention is that the resulting liners exhibit increased density and penetration performance due to their constituent alloys being produced by metal casting methods and not by powder metallurgy. An advantage of one embodiment of the invention is that more ductile high-density alloys can be processed by conventional foundry and mill practices to provide better jets for armor penetration. Another advantage is that given that the invented alloy is partially comprised of iron, its cost is much less than alloys containing cobalt, tantalum, and/or molybdenum.

Still another object of one embodiment of the present invention is to provide alloys having increased ductility and density. A feature of one embodiment of the invention is that the alloys have cast ductility values of at least about 55-60 percent, and a forged/annealed ductility value of at least about 45 to 50 percent. Another feature of one embodiment of the invention is that the alloy has a density greater than about 10 g/cm$^3$ (grams per cubic-centimeters). An advantage of one embodiment of the invention is that the increased ductility results in greater penetration potential in shaped charges scenarios.

Yet another object of one embodiment of the present invention is to provide a charge liner with relatively higher penetration potential, and therefore lethality, compared to the prior art. A feature of one embodiment of the invention is that the alloy has grain sizes less than about 100 microns, typically between about 10 microns and about 80 microns, and preferably between about 15 and about 60 microns. An advantage of one embodiment of the invention is that these finer grain sizes facilitate uniform deformation during jet formation, enabling the alloy to maintain a charge jet for extended periods of time, thereby enhancing penetration ability.

Another object of one embodiment of the present invention is to provide a low cost charge liner and a method for producing a low cost charge liner. A feature of one embodiment of the invention is the elimination of high cost metals such as cobalt, wherein the liner alloy comprises tungsten, iron and nickel. An advantage of one embodiment of the invention is that the iron in the invented alloy confers greater strength, while maintaining densities similar to prior art liner alloys. As such, the invented alloy provides both good strength and elongation characteristics at lower costs than prior art alloys.

Briefly, one embodiment of the invention provides an alloy with a density greater than 10 g/cm$^3$, the alloy comprising a single phase solution of tungsten, nickel, and iron.

Also provided is a cone liner for use in shaped charges, the liner comprised of a tungsten, nickel, iron alloy having a single phase microstructure. Substantially no precipitates or second phases exist in the alloy.

One embodiment of the invention further provides a method for producing a single phase alloy, the method comprising establishing a melt of iron and nickel; dissolving tungsten in the melt to form a solution; wherein the atomic weight percents of the nickel, tungsten and iron range from between approximately Ni:7%W:0%Fe, Ni:18%W:0%Fe, and Ni:8%W:24%Fe, wherein Ni is the remainder; maintaining the solution at a first temperature sufficient to create a homogeneous mixture; allowing the homogeneous mixture to solidify; and thermochemically treating the solidified mixture for a time to dissolve any metastable second phases or microstructure.

BRIEF DESCRIPTION OF DRAWING

One embodiment of the invention together with the above and other objects and advantages will be best understood from the following detailed description of the preferred embodiment of one embodiment of the invention shown in the accompanying drawings, wherein.

DETAILED DESCRIPTION OF THE INVENTION

Figure 1:
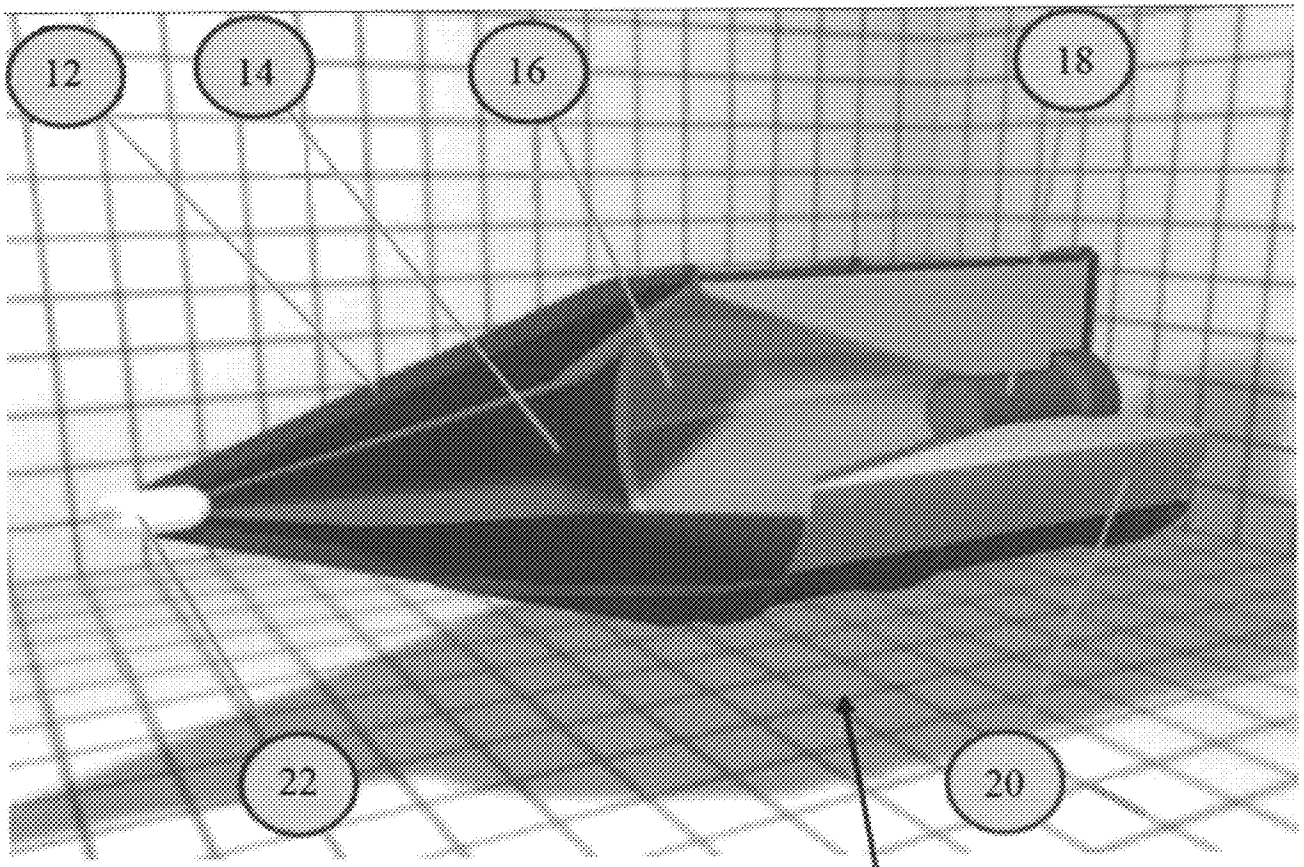
PRIOR ART FIG. 1
FIG. 1 is a prior art depiction of a shaped charge construct.

The foregoing summary, as well as the following detailed description of certain embodiments of one embodiment of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of one embodiment of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

One embodiment of the invention comprises a material system for developing alloys with increased density (versus OFHC Copper) and penetration performance in shaped charge liners. The invented alloys exhibit a higher sound speed and density which directly relate to the performance of the shaped charge device. Generally, the invented alloys are nickel-based solid solutions having a crystal structure substantially that of face-centered cubic.

Compared to copper containing alloys, the invented alloy provides better penetrating capability or lethality by virtual of the higher density and sound speed. Additionally, this alloy possesses higher tensile strength, a higher shear moduli and better thermomechanical properties so that the shaped charge jet formed yields a longer continuous metal jet adding to its already high penetrating ability. Cone liners constructed of this alloy greatly enhances the performance of an explosive formed projectile, such as a shaped-charge jet.

The alloys can be processed by conventional foundry and mill practice. The alloys also have the potential of reduced costs while still exhibiting improved performance.

Specifically, one embodiment of the invention provides an alloy that possesses higher bulk density and bulk longitudinal and shear sound speeds than copper. In an embodiment of the invention, single phase alloys exhibiting densities on the order of greater than about 10 g/cm$^3$ are generated. Furthermore, the alloys generated are single phase, with a grain size of less than about 100 microns, and most preferably between about 20 microns and about 40 microns.

One embodiment of the invention generates finer grain sizes, so noted above. Such fine grain processing results in more uniformly deforming material. Refining the grain size generally results in not only a finer grain size but also a uniform grain size. Both of these characteristics result in more uniform deformation of the material. In large (i.e., not refined) grained materials, there is the possibility that one or few grains are favorably oriented for deformation. As a result, only those grains will deform, and extensively, leading to a premature failure and a degradation in performance. In summary of this point, one embodiment of the invention provides shape charges wherein the alloy deforms uniformly.

One embodiment of the invention provides a metallic alloy having a high density (greater than about 10 g/cm$^3$), and properties suitable and appropriate for use as components in shape charge explosives. A salient feature of the invented metallic alloy is that it is substantially a single phase material (i.e., a solid solution defining a single solid phase microstructure. In such a solution, the crystal structure of the solvent (the nickel/iron matrix) remains unchanged by the addition of the solute (tungsten).)

An embodiment of the invented alloy's preparation protocol substantially minimizes formation of precipitates/second phases. Such detrimental phases otherwise compromise the penetration characteristics of the liner inasmuch as percent elongation (which is a measure of ductility) often degrades with the presence of a second phase. Therefore, the initial collapse of the cone liner to the formation of a co-axial jet stream may be non-uniform in the presence of other phases and/or precipitates.

An embodiment of one embodiment of the invention comprises tungsten, iron and nickel (inventors' acronym TIN). The tungsten provides density while both tungsten and iron provide solid solution strengthening at high temperature. The tungsten additions are maximized while still keeping the alloy composition within the single phase region (hatched region of the ternary diagram, FIG. 2).

Figure 2:
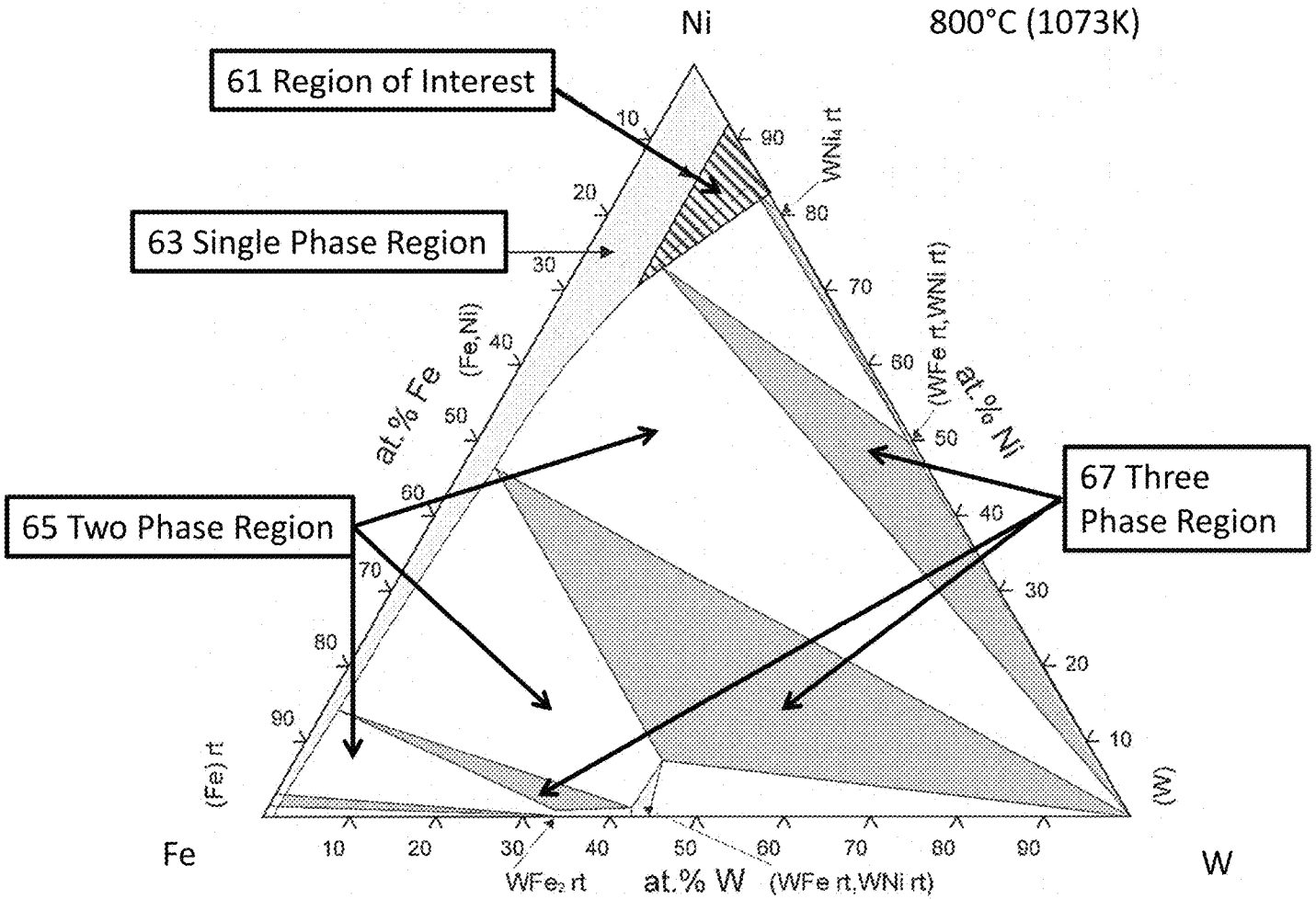
FIG. 2 is a ternary diagram of components of a metal alloy, in accordance with features of one embodiment of the present invention.

FIG. 2 shows the approximate (hatched) most preferred region of interest 61 in the Ni—Fe—W ternary phase diagram. In this region of interest 61 the resulting alloys have a single phase microstructure and the density is generally greater than about 10 g/cm$^3$. The region of interest 61 can be loosely defined as compositions that fall within the slanted line-shaded triangle region defined by the compositions at the three corners as: Ni-7%W-0%Fe, Ni-18%W-0%Fe, and Ni-8%W-24%Fe (in atomic percent). These compositions should be construed as nickel being the remainder (e.g., the major solvent constituent). Generally, nickel concentrations can vary from 50 weight percent to 85 weight percent, preferably from 55 weight percent to 80 weight percent and most preferably, from 58 weight percent to 65 weight percent.

From an approximate weight percent perspective, the vertices of the composition triangle correspond to Ni-19%W-0%Fe, Ni-41%W-0%Fe and Ni-22%W-20%Fe in weight percent. Exemplary compositions include, but are not limited to, approximately Ni-27%W-15%Fe, and approximately Ni-28%W-0.6%Fe, in weight percent.

The light grey regions of FIG. 2 represent single-phase regions 63, the white areas represent two phase regions 65, and the dark grey regions represent three phase regions 67. Many compositions outside of the most preferred slanted line region have either a multi-phase microstructure or have a density lower than 9 g/cm$^3$.

Table 1, infra, is a side-by-side comparison of shaped-charge related properties for copper and the invented alloy.

Based on the bulk sound speed measured, the tip velocity of the shaped-charge jet constructed of the invented alloy can achieve ≥0 km/sec if the manufacturing tolerances are tightly maintained. By comparison, maximum tip velocities of copper liners are typically between 8-9 km/sec. Bulk sound speed is defined as the square root of the division of bulk modulus by the bulk density of the material. Hence, sound speed, modulus and density are interrelated and are intrinsic material properties.

TABLE 1

| | OF Copper | TIN Alloy |
|---|---|---|
| Density (g/cm$^3$) | 8.95 | 10.47 |
| Longitudinal sound speed (km/s) | 3.9-4.7 | 5.32-5.39 (measured in two directions) |
| Shear sound speed (km/s) | ~2.3 | 2.84-2.85 |
| Rockwell hardness B scale | ~40 | ~78.6 |
| Yield Strength | ~76 MPa | ~295 MPa |
| Ultimate Strength | ~241 MPa | ~1175 MPa |
| Elongation | ~45-55% | ~45-60% |

The aforementioned tip velocity of the jet comprised of the invented alloy depends on the use material that has an inherent high sound speed and a high explosive that can produce high detonation speed and pressure. Most of the modern high explosives (e.g. polymer bonded explosives (PBX), research department Formula/Trinitrotoluene (RDX/TNT), etc) the inventors use in their shaped-charges are capable of very high detonation speed (8+km/s) and pressure.

As noted supra, the invented alloy can be produced with traditional melt-cast method. Due to the invented production protocol, whereby detrimental second phases and detritus is processed out, high-purity constituent element feedstocks are not necessary to produce this invented alloy.

Alloy Production

Detail

An embodiment of the invented alloy is that it is fabricated from three main constituent elements. One of the constituent elements of the alloy is tungsten. The inventors have found that higher amounts of tungsten maintain high density in the single phase alloy. Specifically, solubility of W in the matrix is a function of temperature. At higher temperatures the solubility is higher but the solubility decreases at cooler temperatures, resulting in tungsten particles precipitating out. However, tungsten does not diffuse very fast in the solid alloy. A salient feature of one embodiment of the invention is loading up the matrix with tungsten at high temperature and cooling the matrix at a speed to maintain the tungsten in solid solution. The speed is determined to be less than the time it takes for tungsten to diffuse to other tungsten atoms and form a tungsten particle.

A suitable quantify of tungsten is between about 20 weight percent and about 45 weight percent of the alloy, preferably about 25 to 35 percent, and most preferably about 26 weight percent to about 29 weight percent of the alloy composition.

Another salient feature of the invented method is that multiple purification steps are not necessary to arrive at the liner alloy. Rather, a single thermomechanical process is utilized to attain the purity necessary to achieve the high penetration characteristics sought. Notwithstanding the foregoing, while purities from about 99.5 percent to 99.9 percent are possible, purities as low as about 99 percent are suitable.

High purity elements are not needed to fabricate this alloy; rather, reclaimed constituent elements can be used. For example, the tungsten elements can be reclaimed from standard tungsten-containing tooling, high-voltage tungsten-containing switches and breakers, and radiation shielding panels. Various metallurgical extraction-reclamation processes exist to selectively extract the tungsten from scraps.

Melt Cast

Process Detail

The invented alloy can be fabricated with traditional melt-cast process used by steel foundries. As such, powder metallurgical-sintering processes are not required to produce the alloy. This feature of one embodiment of the invention results in it being less expensive than powder metallurgy processes. At the same time, the invented protocol generates the fine grain sizes discussed supra, and this results in the elimination of particle reinforcement seen in state of the art processes. As also discussed supra, the invented alloy does not form particles during the shaped charge process. Rather, the invented alloy provides a single continuous stream (e.g., jet, rod or slug, etc) of particles to maximize penetration.

Inert reaction atmospheres (e.g. vacuum, helium, nitrogen, argon cover gases) are generally preferred but not required. For example, the inventors have poured molten alloy in air with no adverse effects. Most preferably though, the alloy is melted and cast under a nonreactive or substantially nonreactive (e.g., no oxygen or low oxygen) atmosphere. Vacuum casting is a preferred method for fabrication.

This alloy possesses sufficient ductility to be formed into traditional cone liner configuration using hydraulic press or hydroform processes. The as-cast material is envisioned to have a minimum of about 20 percent and a maximum of about 30 percent ductility (with an average being about 25 percent ductility) while the worked and annealed material should approach a maximum of about 70 percent ductility, with a high value of about 60-65 percent ductility being more typical, such that a range of ductility between about 40 percent and about 60 percent is consistently realized using standard, commercial metal working practices.

Figure 4:
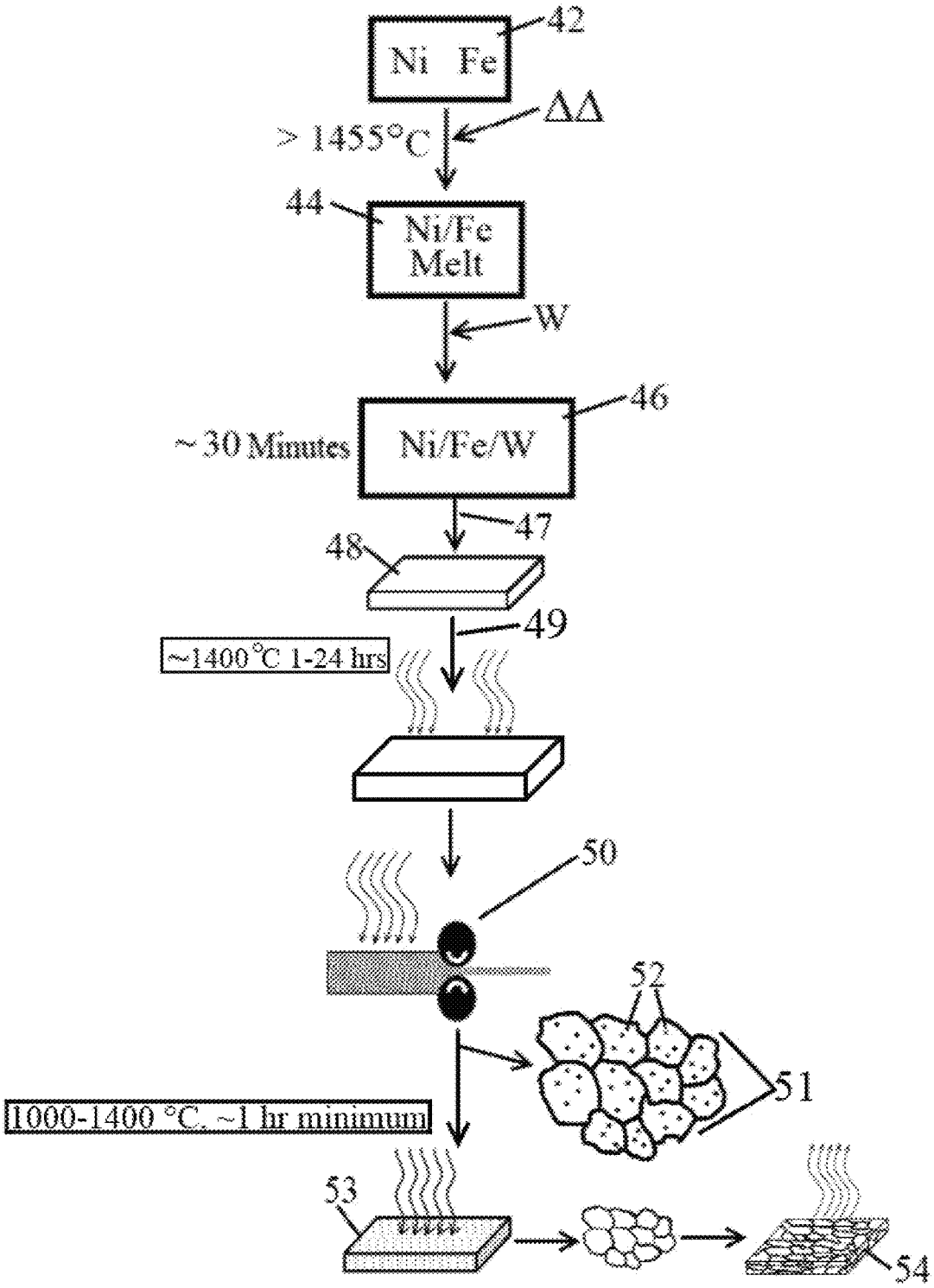
FIG. 4 is a flow chart of the method for producing highly ductile alloy, in accordance with features of one embodiment of the present invention.

The alloys within the composition range defined in the ternary phase diagram depicted in FIG. 2 may be made by conventional metallurgical practices. FIG. 4 is a schematic for a suitable production protocol. The alloys may be made by melting appropriate quantities of the individual elements —Ni, Fe and W—at temperatures above about 1455° C., and preferably between about 1500° and about 1525° C. Alternatively, any combination of elemental material and/or alloy(s) with the appropriate composition may be used in the casting process to obtain the final desired composition in the alloys-of-interest region shown in FIG. 2.

The constituents are held at the casting temperature until all the elements have been completely dissolved. (Elemental tungsten will not melt at this temperature, however, it will rapidly dissolve in liquid nickel and/or liquid nickel/iron melts.) In one embodiment of the method, initially all of the metals are combined together in their solid phases at the same time. The temperature of the mixture is then raised to above approximately the melting point of nickel (e.g. 1455° C.). As the nickel begins to liquefy, the tungsten and iron start to dissolve. As the tungsten content of the melt increases, the melting temperature of the mixture melt also increases. Thus, to maintain the mixture above the liquidus of the final composition melt, the temperature of the melt is heated to range from about 1500° C. to about 1525° C.

In another embodiment of the invented method, depicted in FIG. 4, nickel and iron are first provided 42 and then subjected to a melting step 44. Then, tungsten is added to the melt 46. Generally, suitable dissolve times range from between about 15 minutes and about 60 minutes, depending on the form of tungsten used. For example, approximately 30-45 minutes is a preferred dissolve time, with about 30 minutes a most preferred time, as depicted in FIG. 4.

The ternary mixture 47 is then cast 48 into a mold with the appropriate runners, gates and risers to produce a sound casting with minimal defects such as porosity. Casting is done using standard nickel-based alloy casting practice. An exemplary reference for such standard techniques is Donachie, Matthew J. Donachie, Stephen J. (2002). Superalloys—A Technical Guide (2nd Edition). ASM International, the entirety of which is incorporated by reference. The casting is allowed to solidify.

A salient feature of the invented alloy and method is that the alloy remains as a single phase after solidification. This facilitates the use of standard industrial processes such as pressing, forming, rolling and machining. Generally, castings 48 are subjected to a high temperature homogenization treatment 49 at just below the solidus temperature (the time at the high temperature depends on the thickness of the casting and can range from about 1 hour to about 24 hours or more) to eliminate local variation in composition. The times and temperatures are empirically determined. For example, with homogenizing casts having dimensions of 16×16×3 inches, suitable homogenization temperatures below about 1500° C. are suitable, with temperatures between about 1100 and about 1450° C. preferred, and temperatures 1200-1400° C. most preferred.

During homogenization treatments 49, any second phases generated at the local level dissolve and the composition throughout the casting becomes uniform. Since this uniform composition does not exceed the solubility of tungsten in the matrix, cooling of the homogenized casting will not result in reforming second phase particles. Rather, the homogenized casting it will be single phase when cooled after the homogenization treatment.

After the homogenization step 49, the casting is thermomechanically processed 50 to refine the microstructure.

Tungsten feedstock can be of several forms, depending on the melt protocol and equipment. For example, if elemental tungsten is added in large chunks to an existing melt or to solid phases of iron and nickel, it will take more time to dissolve. However, if scrap tungsten heavy alloys are the tungsten sources, these sources present as tiny spheres (<100 microns in diameter). This form of tungsten initially can be initially present in solid form with solid phases of ion and nickel to form a solid mixture. Once the matrix partially melts at about 1480° C., the tiny spheres of tungsten rapidly dissolve in the liquid. Alternatively, once the melt is established, the tiny tungsten spheres can be added thereto.

Generally, a maximum of about 30 minutes of heating ensured the tungsten spheres were completely dissolved.

Powder Metallurgy

Process Detail

Alternatively, the alloy can be made by powder metallurgy methods in which appropriate metallic powders are mixed together in the proper proportions and consolidated. The green compact is then heated in an inert or reducing furnace atmosphere where the green compact consolidates to form a component exhibiting nearly theoretical density. Pressure may also be applied to compress the mixture, and therefore speed its consolidation. Pressures between approximately 20,000 psi and approximately 60,000 psi are suitable.

There are two avenues for powder metallurgy fabrication: In one avenue, the powders are mixed and then pressed at about 20,000 to about 60,000 psi, to form a "green" compact. This green compact is then placed in a furnace and pressure-less sintered at high temperature, generally at between about >0.5 of the melting point to just below the melting point.

In the other avenue, the powder is placed in a sacrificial "can" or container, evacuated and sealed, usually by welding. The can is then put in a hot isostatic press, heated to high temperature while externally pressurized to between about 20,000 to about 60,000 psi and held to some period of time sufficient to consolidate the powder inside the can (the can is basically crushed around the powder). It is then cooled and the "can" material is stripped off the consolidated part.

Preferably, the compact is heated for a sufficient amount of time to allow for diffusion of the various constituents within the compact to yield a compositionally homogeneous material with a single phase microstructure.

Post Fabrication Processing

The solidified casting can then be homogenized and thermomechanically processed 50 to eliminate the solidification microstructure and residual porosity to obtain a single phase, defect-free material. This thermomechanical process step can take the form of a rolling mill or forging mill. Post-casting, thermomechanical processing is a "heat it and beat it" step which could entail, but is not limited to, a homogenization heat treatment at 1200° C. for 24 hrs followed by cooling and either hot rolling, forging, swaging, etc. to break up the as-cast microstructure. This breaks down the dendritic structure and closes or otherwise minimizes any residual porosity. It also helps eliminate variations in composition that arise during solidification.

As noted above, this processing can occur in air and at ambient pressures. However, inert atmospheres (e.g., nitrogen, argon, helium, low oxygen concentrations) may be preferred depending on the purity of the alloy required. For example, it may be that oxides which form during in air processing are to be avoided; in such instances, inert atmospheres are utilized.

After thermomechanical processing, the material can be subjected to a final heat treatment step 53 at a temperature in the single phase region (this temperature is alloy dependent) and rapidly cooled. The post thermomechanical processing promotes recrystallization of the material and dissolves any second phases 51 interspersed within the otherwise neat matrix 52 that may have developed during mechanical processing.

The final product 54 is then quenched at temperatures below that temperature applied in the final heat treatment step 53. The quenching or cooling action is depicted as upward extending arrows from the final product in FIG. 4. Generally, any cooling means to reduce the temperature of the final product to less than or equal to about 100 C within about an hour or less will suffice to keep tungsten in "solution," as discussed supra. In an embodiment of the invention, cooling methods such as air quenching, forced air quenching, spray quenching, water quenching or oil quenching, generally will achieve the desired cooling profile. The inventors have found that the faster the final product can be cooled, the better, such that reaching a final cooled temperature of at or below 100 C within 60 minutes, (e.g., within 20 to 60 minutes or within about 30-45 minutes) is desirable.

A myriad of coolants are suitable for cooling the final product, including but not limited to air, water, oil, pressurized fluids, and combinations thereof. Suitable temperatures of these coolants range prior to contact with the final product 54 from about 0° C. to about 100° C.

Example

An alloy with the nominal composition of Ni-10%W-1.3%Fe, in atomic percent (or Ni-26%W-1%Fe, in weight percent) was cast into a billet by melting elemental nickel and dissolving a nickel-base tungsten alloy at 1525° C. In this notation Ni is the remainder, so specifically, the composition in atomic percent was 88.7%Ni, 10%W and 1.3%Fe.

Figure 3:
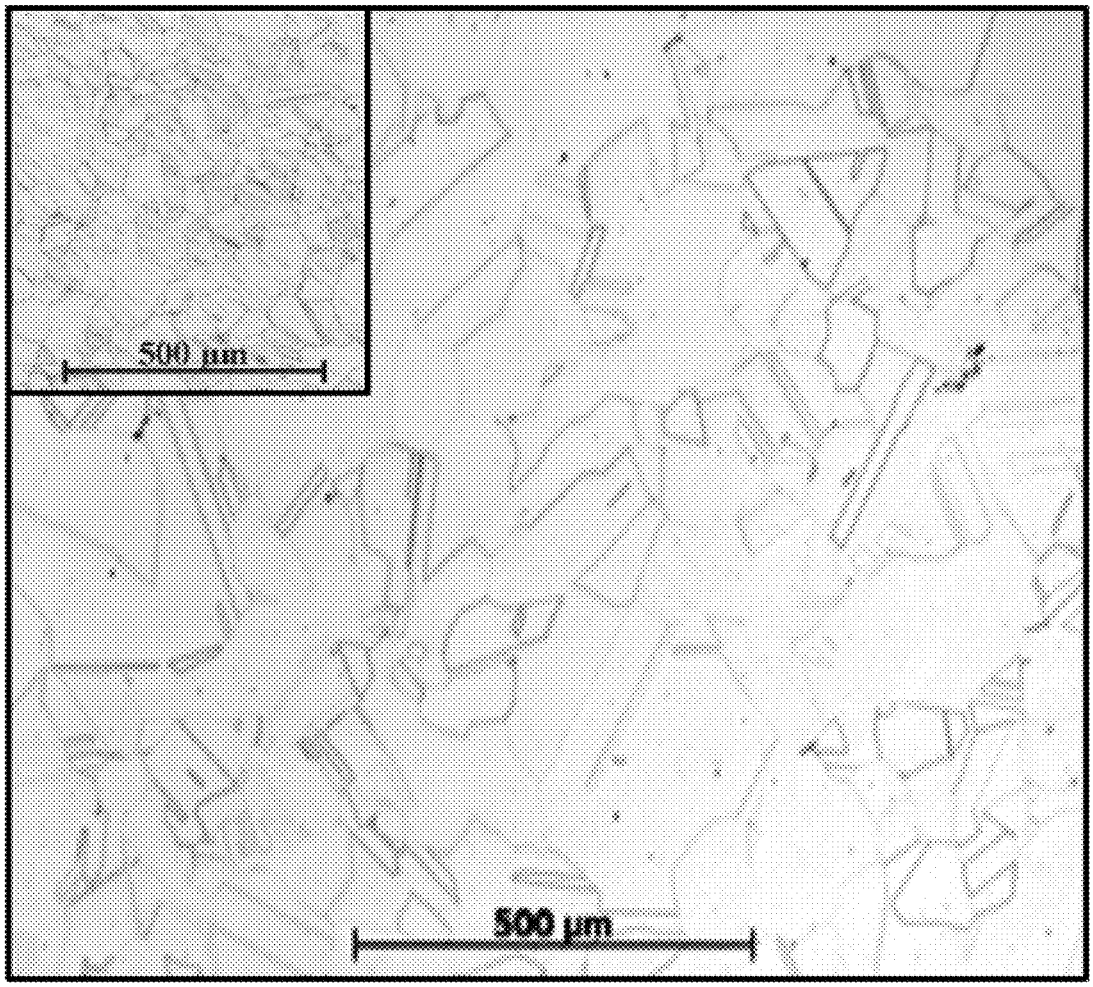
FIG. 3 is a photomicrograph of the crystal structure of the invented alloy after rolling and annealing, in accordance with features of one embodiment of the present invention.

The alloy was cast into a sand mold to form billets with nominal dimensions of 16"×18"×3". A small amount of porosity was found in the casting after solidification. The billets were homogenized at 1200° C. for up to 24 hours and rolled ~50% at about 975° C. The resulting microstructure after heat treating at 1100° C. for 2 hours was single phase with a relatively small grain size of <100 microns, FIG. 3. (Some small residual porosity remains in FIG. 3 that can be eliminated with optimized thermomechanical processing.)

In summary, one embodiment of the invention provides an alloy comprising a solid solution, such that the mixture remains in a single homogeneous phase. This solid solution state can be distinguished from a mechanical mixture, the latter of which exhibits miscibility gaps in solid state. The invented alloy has substantially no miscibility gaps in solid state, due to the extremely limited atomic mobility of tungsten in the alloy. As such, even at room temperatures, it remains a metastable single phase alloy.

It is to be understood that the above description is intended to be illustrative, and not restrictive. For example, the above-described embodiments (and/or aspects thereof) may be used in combination with each other. In addition, many modifications may be made to adapt a particular situation or material to the teachings of one embodiment of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of one embodiment of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, one embodiment of the present invention encompasses not only the entire group listed as a whole, but each member of the group individually and all possible subgroups of the main group. Accordingly, for all purposes, one embodiment of the present invention encompasses not only the main group, but also the main group absent one or more of the group members. One embodiment of the present invention also envisages the explicit exclusion of one or more of any of the group members in the claimed invention.

The embodiment of one embodiment of the invention in which an exclusive property or privilege is claimed is defined as follows:

1. A shaped charge jet consisting of:

an alloy with a density greater than 10 g/cc and a worked and annealed ductility of up to about 60 percent;

the alloy comprising a single phase solution of tungsten, nickel, and iron;

the single phase solution having a composition expressed, in atomic percent, by a composition formula of $Ni_{100-(a+b)}W_aFe_b$ wherein 7.0<a<18.0 and 0.0<b<24.0; and a tip having a velocity of the shaped-charged jet is at or greater than 10 km/sec.

2. The alloy as recited in claim 1 wherein the tungsten is present at between about 19 weight percent and about 41 weight percent tungsten.

3. The alloy as recited in claim 1 wherein the nickel is present at between about 58 weight percent and about 81 weight percent.

4. The alloy as recited in claim 1 wherein the alloy has a grain size of between approximately 10 microns and approximately 100 microns.

5. The alloy as recited in claim 1 wherein the alloy is the constituent in a shaped charge liner.

6. The shaped charge jet recited in claim 1 having a longitudinal sound speed of approximately 5 to approximately 5.5 km/sec.

7. The shaped charge jet recited in claim 1 wherein the tip velocity of the shaped-charge jet is at or greater than 10 km/sec when PBX is utilized as explosive.

* * * * *